US007544091B2

(12) United States Patent
Klein et al.

(10) Patent No.: US 7,544,091 B2
(45) Date of Patent: Jun. 9, 2009

(54) INSULATED BOX HAVING READILY ACCESSIBLE CONDUCTOR TAP CAPABILITIES

(75) Inventors: Hans Joergen Klein, Nordborg (DK); Gert B. Jakobsen, Soenderborg (DK); Hans Erik Fogh, Broager (DK); Erik Raun Jensen, Nordborg (DK)

(73) Assignee: Danfoss A/S, Nordborg (DK)

( * ) Notice: Subject to any disclaimer, the term of this patent is extended or adjusted under 35 U.S.C. 154(b) by 9 days.

(21) Appl. No.: 11/629,430

(22) PCT Filed: Jun. 17, 2005

(86) PCT No.: PCT/DK2005/000397

§ 371 (c)(1),
(2), (4) Date: Dec. 13, 2006

(87) PCT Pub. No.: WO2005/125293

PCT Pub. Date: Dec. 29, 2005

(65) Prior Publication Data

US 2007/0178758 A1 Aug. 2, 2007

(30) Foreign Application Priority Data

Jun. 18, 2004 (DK) ..... 2004 00953

(51) Int. Cl.
*H01R 13/73* (2006.01)

(52) U.S. Cl. ..... 439/572; 439/208; 312/401

(58) Field of Classification Search ..... 439/572, 439/208; 312/400, 401, 223.6
See application file for complete search history.

(56) References Cited

U.S. PATENT DOCUMENTS

| | | | | |
|---|---|---|---|---|
| 3,405,986 | A * | 10/1968 | Cannon | 312/406.2 |
| 3,590,136 | A | 6/1971 | Kunishi et al. | 174/50 |
| 4,489,995 | A * | 12/1984 | Barr | 312/236 |
| 4,572,923 | A * | 2/1986 | Castellani et al. | 174/483 |
| 5,238,299 | A | 8/1993 | McKinney | 312/406 |
| 5,243,130 | A | 9/1993 | Kitagawa | 174/50 |
| 5,381,598 | A | 1/1995 | Adachi et al. | 29/845 |
| 5,985,189 | A | 11/1999 | Lynn et al. | 264/46.5 |
| 6,038,126 | A | 3/2000 | Weng | 361/679 |

FOREIGN PATENT DOCUMENTS

| | | |
|---|---|---|
| DE | 198 10 571 C1 | 5/1999 |
| EP | 1 075 169 A1 | 2/2001 |
| FR | 2 609 268 | 7/1988 |
| JP | 4-257684 | 9/1992 |
| JP | 2004-36924 | 2/2004 |

* cited by examiner

*Primary Examiner*—Briggitte R Hammond
*Assistant Examiner*—Vanessa Girardi
(74) *Attorney, Agent, or Firm*—McCormick, Paulding & Huber LLP

(57) ABSTRACT

An insulated box, suitable as a refrigerator, having readily accessible conductor current tap capabilities for electrical/electronic components within the box. The box has a wall made with electrically separated layers and having an electrical conductor incorporated between the layers. The components are connected to the conductor via entry points through which a conductive member can penetrate one of the layers and thereby establish contact between the conductor and electronic components. Thereby it is achieved that electrical components can be fitted to the inner surface of the box by use of the conductor which is incorporated between the layers and without implying additional fastening of conductors to an outer surface of the box. In particular, the invention facilitates refitting of electrical components in a refrigerator.

10 Claims, 3 Drawing Sheets

INSULATED BOX HAVING READILY ACCESSIBLE CONDUCTOR TAP CAPABILITIES

CROSS REFERENCE TO RELATED APPLICATIONS

This application is entitled to the benefit of and incorporates by reference essential subject matter disclosed in International Patent Application No. PCT/DK2005/000397 filed on Jun. 17, 2005 and Danish Patent Application No. PA 2004 00953 filed Jun. 18, 2004.

FIELD OF THE INVENTION

The invention relates to a box with a cavity for housing electronic components, e.g. a thermally insulated box forming a cabinet of a refrigerator.

BACKGROUND OF THE INVENTION

In refrigerators, various electrical components, e.g. lights, temperature sensors etc. are housed in a cavity surrounded by a wall structure which provides thermal insulation. The wall structure normally consists of an inliner and an outliner separated by a foam material, e.g. polyurethane foam. Electrical connection between the components and ambient power supply or control systems e.g. for regulating temperature of the refrigerator, is normally constituted by bundles of cables extending between desired locations on an inner surface of the cavity and desired locations on an outer surface of the box. The cables extend between these locations inside the wall structure, i.e. between the inliner and the outliner, and they are encapsulated in the foam material. In that way, the layout of the inner and outer surfaces can be simplified.

Since the foam material is normally adhered in direct contact with the inliner and the outliner, it is difficult to locate cables inside the wall structure, and after the assembling of the wall structure, it is impossible to position new cables inside the structure. In the assembling process for making refrigerators, electrical components are normally wired through passages extending throughout the wall structure, and evidently, such penetration of the thermally insulating foam material is undesired with respect to the insulating capability and with respect to the layout of the inner or outer surface along which the additional cables will be exposed.

BRIEF SUMMARY OF THE INVENTION

It is an object of the invention to provide a box which in an improved manner facilitates manufacturing and in particular fitting of internal electrical components. Accordingly, the invention in a first aspect provides a box housing electronic components in a cavity, the box comprising:

- a wall structure with an inliner, an outliner and a space there between, the inliner having an inner surface forming a wall of the cavity, and an opposite outer surface towards the outliner,
- at least one electrical conductor extending from outside the box to the outer surface and along the outer surface to define a conductive path to which an electronic component in the cavity may be connected at any point, and
- at least one entry point wherein a conductive member penetrates the inliner and engages with the conductive path at the outer surface to connect the electronic component to the conductive path.

The conductor may e.g. form an elongated electrical path from outside the box to the cavity of the box, and the conductor may follow a pre-specified path along the outer surface so that the inliner can be penetrated subsequent to the finishing of the wall structure when the space is closed. The conductive path could be in contact with the outer surface, and it could be attached to the outer surface at least at the entry point.

Due to the entry point through which a conductive member may penetrate the inliner, electrical components may be fitted more flexibly, e.g. after the manufacturing of the wall structure. If the conductor follows a pre-specified path, the flexibility will be further increased due to the simplicity in locating a conductor within the finished wall structure.

To enable fitting of electronic components after the space between the outliner and the inliner is sealed, it could be facilitated that the inliner, at the entry point, may be penetrated from the inner surface and that the conductor can be engaged with the conductive member through a narrow opening in the inliner. For this purpose, the conductive member should be located at a known position relative to the inliner, and its position relative to the inliner should preferably be fixed at least in any direction parallel to the inliner so that the conductor does not move away from the narrow opening.

In particular, a box of this kind could be used in combination with a refrigeration system to form a refrigerator cabinet. In such an application, the inliner and the outliner may preferably be separated by a thermally insulating material to form an insulated wall of the refrigerator. The insulating material could be a foam material which is entered into the space in liquid state and which adhesively bonds to both of the liners and to the conductor to form one solid wall structure with the conductor embedded therein.

A flexible circuit board arranged in contact with the outer surface may form part of the electrical conductor. During manufacturing, the flexible circuit board may be attached adhesively to the outer surface, e.g. by strips of adhesive tape or in any similar manner until a point in time wherein the space between the inliner and the outliner is filled with an insulation foam, e.g. polyurethane foam. In the final form, the flexible circuit is held in close contact with the outer surface by the insulation material which is adhered to the foam or embedded in the foam body. To establish electrical contact between the component inside the box and the conductor, a hole could be drilled through the inliner, e.g. from the inner surface. Subsequently, the component, e.g. a lamp or an electrical thermostat, could be fastened to the inner surface by use of a screw or rivet, e.g. a blind rivet which penetrates the inliner and thereby forms part of the tap which electrically connects the component with the conductor.

As an alternative to the flexible circuit board, the electrical conductor may form part of the outer surface. As an example, the conductor may comprise a path of a conductive material which is deposited onto the outer surface, e.g. by vapor deposition.

To enable finding of the conductors in a situation wherein it is desired to refit additional electrical components, the inner surface may comprise one or more marks indicating positions of the conductor on the opposite outer surface.

By arrangement of a plurality of conductors with a fixed position relative to each other, connection can be established by use of a plug with a fixed distance between its connectors. For that purpose, the inner surface may comprise a connector for connecting the conductor with electrical components housed in the box.

To enable connection of power supply or control electronics, the box may further comprise a connector incorporated in the wall structure for connecting the conductor with ambient electrical components. The connector could be molded into the insulation material to be completely embedded in the wall structure, thus forming only a connecting interface on an outer surface of the outliner.

In a second aspect, the invention provides a method of establishing connection across a wall structure with an inliner, an outliner and a space there between, the inliner having an inner surface forming a wall of a cavity, and an opposite outer surface towards the outliner. The method comprises providing at least one electrical conductor extending from outside the box to the outer surface and along a portion of the outer surface, at which portion the conductor forms at least one entry point. The inliner is penetrated at said entry point, and engagement is established between the conductor and an electronic component located in the cavity. This facilitates conduction of an electrical current via the tap to the cavity. The method may further comprise any steps relating to the features of the first aspect. In particular, the conductor may be provided to follow a predefined path along the outer surface so that the penetration may take place at any point along this path. Furthermore, the space may be filled with a thermally isolating material to define a solid wall structure with the conductor embedded therein prior to the penetration and the engagement between the electronic component in the cavity and the conductor. To facilitate the manufacturing process, the conductor may be attached to the outer surface at least at the entry point. The conductor may further be in contact with the outer surface at least at the entry point. The thermally isolating material could be a foam material, e.g. PU-foam, which is subsequently filled into the space in a liquid state and which after solidification improves fixation of the conductor in the space by adhering to the conductor.

BRIEF DESCRIPTION OF THE DRAWINGS

In the following, a preferred embodiment of the invention will be described in further details with reference to the drawing in which.

DETAILED DESCRIPTION OF THE INVENTION

Figure 2:
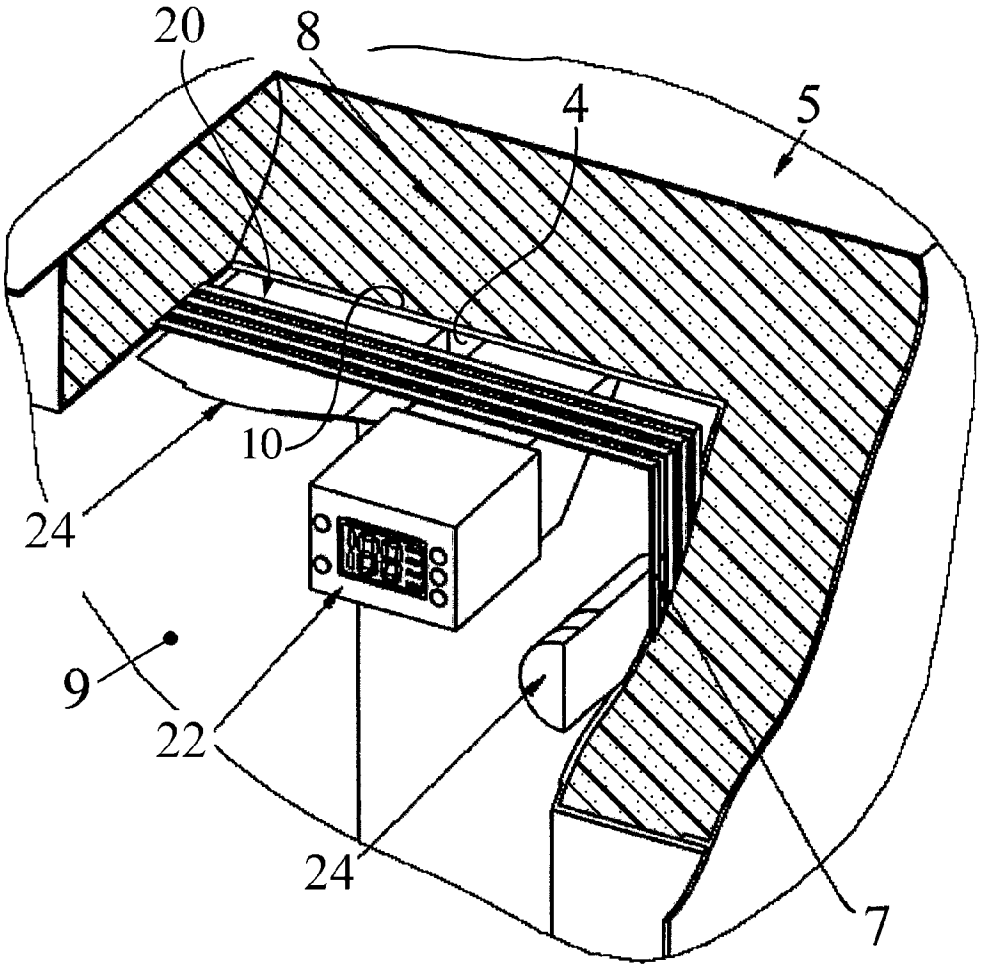
FIG. 2 shows a wall segment having a three layer structure with incorporated electrical conductors.
Figure 1:
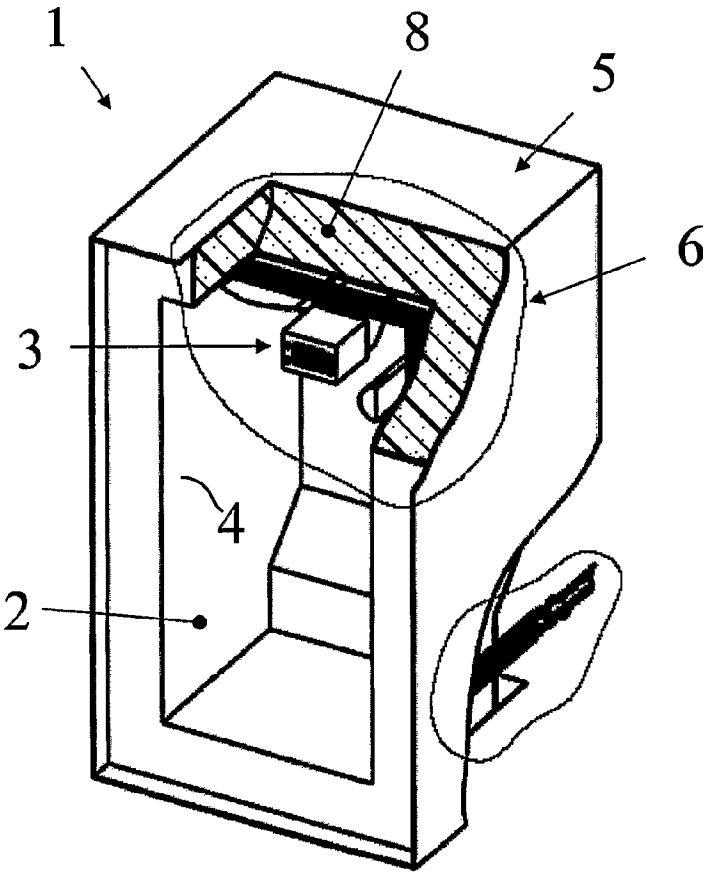
FIG. 1 shows a box according to the invention.

As shown in FIG. 1, the box 1 has a cavity 2 housing electronic components 3. In FIG. 1, the box is constituted by a refrigerator having a wall structure comprising an inliner 4 and an outliner 5. The inliner 4 and outliner 5 are electrically separated by foam of a thermally insulating material 8. FIG. 2 shows a more detailed view of the wall structure, c.f. the sectional view of the encircling 6 in FIG. 1. The electronic components 3 of the refrigerator are constituted by a thermostat 22 and lamps 24 for illuminating the interior of the refrigerator. The refrigerator is fitted with conductors 7 which facilitate connection between the electronic components 3 and ambient electrical systems, e.g. a power supply. The conductors 7 are incorporated in the wall structure and they extend in parallel to each other and parallel to the outer surface 10 of the inliner 4, i.e. between the inliner 4 and the insulating foam material 8.

Figure 3:
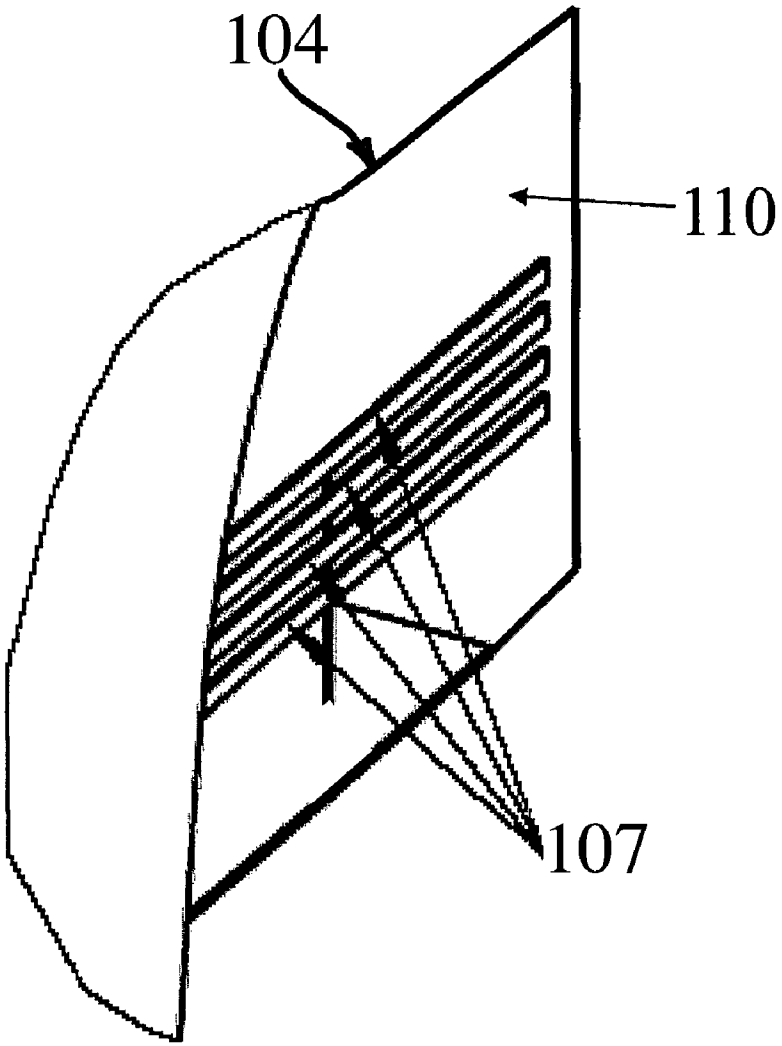
FIG. 3 shows a view of an alternative embodiment of the wall structure.

As shown in FIG. 2, the wall structure comprises an inliner 4 having an inner surface forming a wall 9 of the cavity 2, and an opposite outer surface 10 (c.f. FIG. 3) towards the outliner 5. The electrical conductors 7 conduct an electrical current from outside the refrigerator to the inner surface of the box 1 for powering the lamps 24 and for transferring a signal between the thermostat 22 and a controller or a compressor. As shown, the conductors 7 form elongated electrical paths extending in parallel with the outer surface 10 of the inliner 4. A flexible printed circuit board which is fixed to the outer surface 10 of the inliner 4 could form part of the electrical conductors 7.

The layer 8 of thermally insulating polyurethane foam is arranged between, and in adhesive contact with the inliner 4 and with the outliner 5 and thereby bonds the two liners 4, 5 together. If at least a part of the conductors 7, e.g. the portion extending along a portion of outer surface 10, is embedded in a flexible printed circuit board, the foam 8 may further keep the flexible printed circuit board in place against the outer surface 10 of the inliner 4. Alternatively, it may be glued or otherwise adhered to the outer surface 10.

FIG. 3 shows a view of an alternative embodiment of the wall structure, wherein like numerals represent like elements. In this embodiment, the electrical conductors 107 form part of the outer surface 110 of the inliner 104. To conduct the electrical current, the outer surface 104 comprises an electrically conductive surface pattern which is deposited onto the surface 110, e.g. by vapor deposition or painted onto the surface 110.

Figure 4:
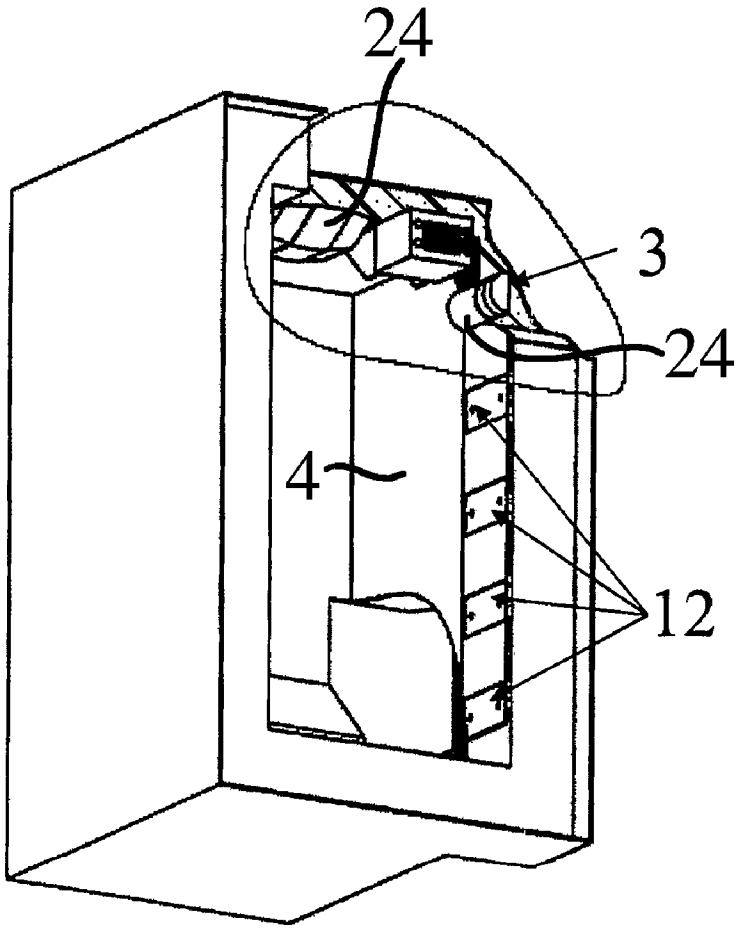
FIG. 4 shows a view of the inner surface of the inliner.

FIG. 4 shows a view of the inner surface of the inliner 4. The markings 12 are printed onto the surface or formed as protrusions or embossing marks into the inner surface and indicate at which locations electrical conductors 7 can be found on the opposite outer surface 10 of the inliner 4. To mount electronic components 3, all that has to be done is to drill a hole through the inliner 4 and fasten the components 3 to the surface by an electrically conductive rivet or screw which engage with the conductors on the outer surface.

Figure 5A:
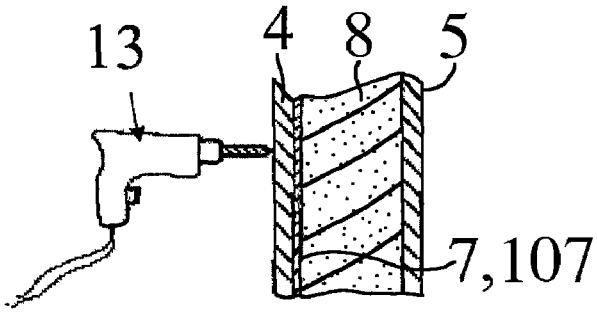
FIGS. 5*a*-5*d* show an assembly sequence for a box according to the invention.
Figure 5B:
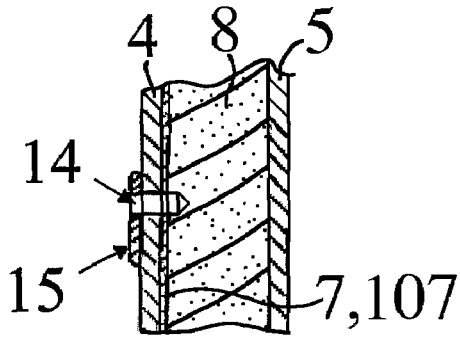
Figure 5C:
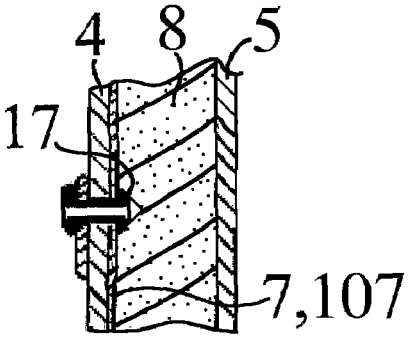
Figure 5D:
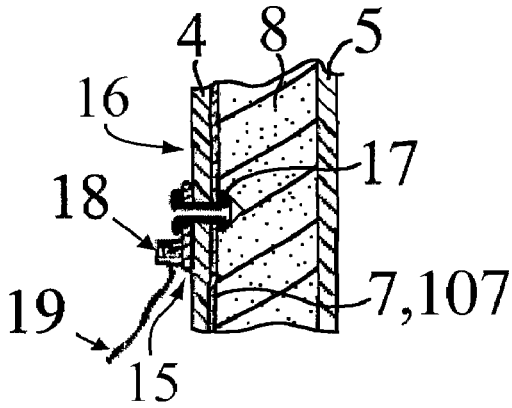

FIGS. 5*a*-5*d* show the use of a regular drill 13 for providing an opening 14 through the inliner 4 and further through the conductor 7, 107. A tap 15 is located on the inner surface 16 of the inliner 4 and a blind rivet 17 is used for attaching the tap 15 to the inner surface 16 and for establishing contact between the conductor 7, 107 and the tap 15. In FIG. 5*d*, the tap 15 comprises a terminal 18 to which a cable 19, e.g. from a lamp is attached.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A box forming a cabinet of a refrigerator, the box housing electronic components in a cavity, the box comprising:

a wall structure with an inliner, an outliner and a space therebetween, the inliner having an inner surface forming a wall of the cavity, and an opposite outer surface towards the outliner, at least one electrical conductor extending from outside the box to the outer surface and along the outer surface to define a conductive path to which an electronic component in the cavity may be connected at any point along the conductive path, and at least one entry point wherein a conductive member penetrates the inliner and engages with the conductive path at the outer surface to connect the electronic component to the conductive path, wherein the electrical conductor forms part of the outer surface.

2. The box according to claim 1, wherein the conductive path is in contact with the outer surface at the entry point.

3. The box according to claim 2, wherein the conductive path is attached to the outer surface at the entry point.

4. The box according to claim 1, further comprising a thermally insulating material located in the space.

5. The box according to claim 1, wherein a flexible circuit board forms part of the electrical conductor.

6. The box according to claim 5, wherein the flexible circuit board is in fixed contact with the outer surface.

7. The box according to claim 1, wherein the conductor comprises a layer of a conductive material deposited on the outer surface.

8. The box according to claim 7, wherein the conductor is deposited by vapor deposition.

9. The box according to claim 1, wherein the inner surface comprises a marking indicating a position of the conductor on the opposite outer surface.

10. The box according to claim 1, comprising a plurality of electrically insulated conductors extending in parallel with the outer surface and being in fixed position relative to each other.

* * * * *